United States Patent [19]

Senda et al.

[11] Patent Number: 4,737,757

[45] Date of Patent: Apr. 12, 1988

[54] THIN-FILM RESISTOR

[75] Inventors: Atsuo Senda; Toshi Numata; Takuji Nakagawa; Yoshifumi Ogiso, all of Nagaokakyo, Japan

[73] Assignee: Murata Manufacturing Co., Ltd., Japan

[21] Appl. No.: 872,950

[22] Filed: Jun. 11, 1986

[30] Foreign Application Priority Data

Jun. 14, 1985 [JP] Japan ..... 60-130400

[51] Int. Cl.[4] ..... H01C 1/012

[52] U.S. Cl. ..... 338/308; 338/309; 338/314

[58] Field of Search ..... 338/314, 308, 309; 252/518, 519, 520, 521; 427/201, 202

[56] References Cited

U.S. PATENT DOCUMENTS 3,591,413 7/1971 Seiki et al. ..... 338/308 X

FOREIGN PATENT DOCUMENTS 0034901 10/1979 Japan ..... 338/314

*Primary Examiner*—C. L. Albritton

*Attorney, Agent, or Firm*—Ostrolenk, Faber, Gerb & Soffen

[57] ABSTRACT

A thin-film resistor comprising a thin film of a nitride of at least one element belonging to groups III–VI of the periodic table. The thin-film resistor has a metal oxide layer comprising at least one metal oxide selected from the group consisting of manganese oxide, iron oxide, cobalt oxide, nickel oxide, zinc oxide, indium oxide, tin oxide and indium tin oxide interposed between the nitride thin film and an electrode for external connection.

11 Claims, 1 Drawing Sheet

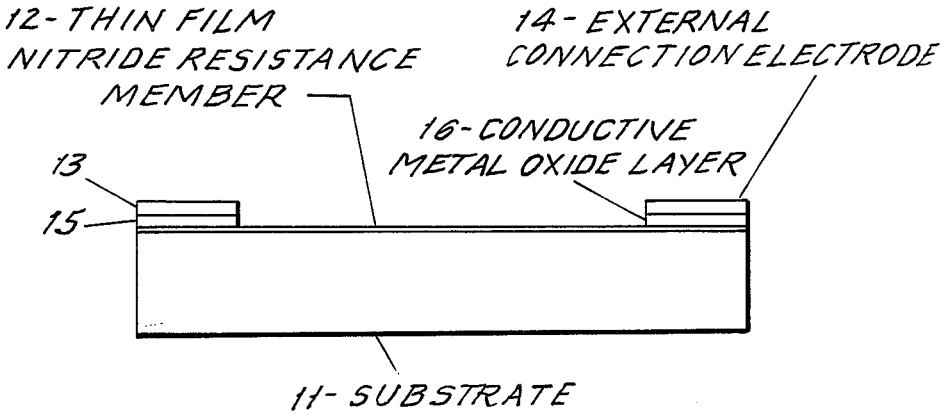
12- THIN FILM
NITRIDE RESISTANCE
MEMBER
14- EXTERNAL
CONNECTION ELECTRODE
16- CONDUCTIVE
METAL OXIDE LAYER
13
15
11- SUBSTRATE

THIN-FILM RESISTOR

BACKGROUND OF THE INVENTION

1. Field of the Invention

The present invention relates to a thin-film resistor, and more particularly, it relates to a thin-film resistor provided with a highly reliable thin-film nitride resistance member whose resistance value is not substantially changed under high temperature conditions.

2. Description of the Prior Art

A thin film comprising nitrides of elements belonging to groups III–VI of the periodic table such as tantalum nitride, titanium nitride, zirconium nitride, hafnium nitride, aluminum nitride, niobium nitride, boron nitride and chromium nitride is known to be stable under high temperature conditions and to be excellent in electrical characteristics. A highly reliable thin-film resistance member of a precision type having a small resistance temperature coefficient may be formed from one of these nitrides or from a combination of two or more such nitrides. Also, a thin film comprising nitrides of elements belonging to groups VII and VIII of the periodic table such as $Mn_2N$, $Mn_3N_2$, $Mn_4N$ and $Fe_2N$, $Fe_4N$, CoN, $Co_2N$, $Co_3N_2$, $Ni_3N$ and $Ni_3N_2$ is known to be stable under high temperature and excellent in electric characteristics.

Such a thin-film nitride resistance member is formed on an insulating substrate of glass, ceramic material, etc. by a method such as electron beam deposition, ion beam deposition, flash deposition, cathode sputtering deposition and the like. Such a thin-film resistance member can also be formed by hot press, sublimate recrystallization, discharge reaction or chemical vapor deposition. In general, such thin-film resistance members are usually formed through reactive sputtering deposition performed in an atmosphere of high-purity nitrogen gas and high-purity argon.

The thin-film nitride resistance member is provided thereon with an electrode for external connection, which comprises a multi-layer electrode of Cr-Cu, Cr-Au, Ni-Cu, Ni-Au, Ni-Ag, NiCr-Au, Ti-Pd-Au, Ti-W-Au and the like. In an external connection electrode having a multi-layer structure, a first layer of Cr, Ni, NiCr or Ti serves as an adhesion layer for the thin-film nitride resistance member and an outer layer of Cu, Au or Ag serves as a solderable layer.

Such a resistor provided with a thin-film nitride resistance member shows no change in characteristics in lifetime tests such as a moisture-resistance loading test at the room temperature. However, tests have been performed in which the resistance value of such a resistor was changed when the same was held at a high temperature of, e.g., 150° C. or subjected to a rated voltage loading test at 70° C. Such a phenomenon was observed in resistors both coated and not coated with insulating resin and also in a hermetically sealed one, and the resistance values were changed at equal rates.

This means that the resistance films were changed under high temperature conditions. In an effort to find the cause thereof, it has been proved that the resistance value of such a thin-film nitride resistance member is changed because nitrogen contained in the resistance film is partially dissociated in a contact region between the resistance film and the external connection electrode under high temperature conditions, the nitrogen being transferred to the metal forming the electrode. When, for example, a resistor comprising a thin-film nitride resistance member of zirconium nitride (ZrN) and an external connection electrode formed with a first layer of NiCr and a second layer of Au is held at a temperature of 150° C., the color tone of the zirconium nitride thin film is changed with time in the vicinity of the external connection electrode, from brown to colorless transparency. Such a phenomenon has been analyzed by means such as ESCA and EMX, and it has been found that nitrogen contained in the zirconium nitride thin film is gradually dissociated and transferred to the NiCr in the external connection electrode, causing the color change of the resistance film as well as a change in resistance value.

In other words, the following reaction is caused in the contact portion between the thin-film resistance member and the metal of the external connection electrode:

$$Me^{I}N + Me^{II} \rightarrow Me^{I}N_{I-X} + Me^{II}N_{X}$$

($Me^{I}N$: thin-film nitride resistance member; $Me^{II}$: external connection electrode)

This is because the external connection electrode is made of metal, which traps nitrogen contained in the thin-film nitride resistance member upon application of a high temperature so as to nitrogenize the electrode.

SUMMARY OF THE INVENTION

The inventors have made a study with the object of preventing such a phenomenon, and have found that the aforementioned reaction can be prevented by interposing an intermediate layer such as a stable metal oxide layer, between the thin-film nitride resistance member and the external connection electrode.

Accordingly, it is an object of the present invention to provide a resistor having a resistance film comprising a thin-film nitride resistance member which has small resistance change at a high temperature.

The present invention is directed to a thin-film resistor comprising a thin-film nitride resistance member, an electrode for external connection and a conductive metal oxide layer interposed therebetween and serving as an intermediate layer.

The intermediate layer may be prepared from at least one metal oxide selected from the group consisting of manganese oxide, iron oxide, cobalt oxide, nickel oxide, zinc oxide, indium oxide, tin oxide and indium tin oxide.

In the case of using zinc oxide as the selected one of these materials, the same is advantageously mixed with an additive comprising at least one oxide selected from the group consisting of iron oxide, zirconium oxide, indium oxide, tin oxide and lead oxide so as to include 0.5 to 99.9 percent by mol of the additive oxide or oxides.

The thin-film nitride resistance member serving as a resistance element can be prepared from any of the materials as hereinabove described with reference to the prior art, while the conductive metal oxide layer serving as an intermediate layer must be prepared from a stable metal oxide lower in specific resistance than the thin-film nitride resistance member.

When, for example, the thin-film nitride resistance member is made of zirconium nitride, tin oxide may be selected to form the intermediate layer. When the thin-film nitride resistance member is prepared from tantalum nitride, indium tin oxide may be selected to form the intermediate layer.

The intermediate layer is generally formed by sputtering, and a target material selected from various metals or metal oxides described above is employed to form the intermediate layer from the aforementioned various metal oxides. In any case, sputtering may be performed in an atmosphere containing oxygen. It order to form an intermediate layer of tin oxide, organic tin may be applied by means such as spraying or coating, and thermally decomposed by heat, thereby providing tin oxide.

In addition to the aforementioned sputtering, the intermediate layer may be formed by dry-type thin film forming means such as vacuum deposition and ion plating.

According to the present invention, a conductive metal oxide layer is interposed between a thin-film nitride resistance member and an electrode for external connection, thereby obtaining a stable thin-film resistor with small deterioration of its characteristics, and more specifically small resistance deterioration at a high temperature.

These and other objects, features, aspects and advantages of the present invention will become more apparent from the following detailed description of embodiments of the present invention.

BRIEF DESCRIPTION OF THE DRAWING

The FIGURE shows schematically a thin-film resistor according to an embodiment of the invention as further described hereinbelow.

DESCRIPTION OF THE PREFERRED EMBODIMENTS

Referring to the FIGURE, there is seen a thin-film resistor according to an embodiment of the invention, as further described hereinbelow. A substrate 11 has a thin-film resistance member 12 formed thereon. A pair of external connection electrodes 13, 14 are formed at opposite ends of the resistance member 12. A pair of intermediate layers 15, 16 are interposed between the resistance member 12 and the electrodes 13, 14, respectively.

EXAMPLE 1

A thin-film resistance member of zirconium nitride was formed on an alumina substrate by performing reactive sputtering with a target of metal zirconium in a mixed gas atmosphere of nitrogen and argon under the following conditions:

substrate temperature: 300° C.
mixed gas ratio: nitrogen/argon=20/80 (volume %)
introduced gas pressure: 1 Kg/cm$^2$
introduced gas flow rate: 20 cc/min.
DC output: 400 W (3.0 W/cm$^2$)
gas pressure: $7.5\times10^{-4}$ to $2.0\times10^{-2}$ Torr.

Then a mask was placed on the alumina substrate so as to expose a portion where an intermediate layer was to be formed on the thin-film resistance member of zirconium nitride. Reactive sputtering was performed under the following conditions with a target of tin oxide to form an intermediate layer of tin oxide:

substrate temperature: 250° C.
mixed gas ratio: oxygen/argon=40/60 (volume %)
introduced gas pressure: 1 Kg/cm$^2$
introduced gas flow rate: 100 cc/min.
DC output: 500 W (4.0 W/cm$^2$)
gas pressure: $5\times10^{-3}$ Torr.

A metal layer for soldering was formed of Cu on the tin oxide layer as an external connection electrode by vacuum deposition.

A lead wire was soldered to the Cu layer of the thin-film resistor thus obtained, which was then entirely coated with epoxy resin. In this state, the thin-film resistor was held at a temperature of 150° C. for 1000 hours and then a resistance value was measured in order to compare any change in its resistance value with the measured initial value, with the result that the rate of change was found to be less than 0.1%. Further, no change was recognized in the color tone of the thin-film resistor.

EXAMPLE 2

A thin-film resistance member of zirconium nitride was formed on an alumina substrate in a manner similar to Example 1.

Then a mask was placed on the alumina substrate to expose a portion where an intermediate layer was to be formed on the thin-film resistance member of zirconium nitride. Reactive sputtering was performed under the following conditions with a target of metal nickel, to form an intermediate layer of nickel oxide:

substrate temperature: 250° C.
mixed gas ratio: oxygen/argon=10/90 (volume %)
introduced gas pressure: 1 Kg/cm$^2$
introduced gas flow rate: 100 cc/min.
DC output: 500 W (4.0 W/cm$^2$)
gas pressure: $5\times10^{-3}$ Torr.

A metal layer for soldering was further formed of Cu on the nickel oxide layer as an external connection electrode by vacuum deposition.

The thin-film resistor thus obtained was treated similarly to Example 1 and held at a temperature of 150° C. for 1000 hours. A resistance value was then measured in order to compare any change in its resistance value with the measured initial value. The rate of change was found to be less than 0.1% similarly to Example 1. Further, no change was recognized in the color tone of the thin-film resistor.

EXAMPLE 3

Reactive sputtering was performed on alumina substrates under the following conditions with targets of metal tantalum in a mixed gas atmosphere of nitrogen and argon, to form thin-film resistance members of tantalum nitride having area resistance of 50 Ω/□:

substrate temperature: 300° C.
mixed gas ratio: nitrogen/argon=5/95 (volume %)
introduced gas pressure: 1 Kg/cm$^2$
introduced gas flow rate: 20 cc/min.
DC output: 200 W (2.5 W/cm$^2$)
gas pressure: $0.3\times10^{-2}$ to $2\times10^{-2}$ Torr.

Then a tin oxide film and a nickel oxide film were formed on the resistance members of tantalum nitride respectively as intermediate layers, similarly to Examples 1 and 2.

Thereafter metal layers for soldering were formed of Au on the respective intermediate layers as external connection electrodes by vacuum deposition to form two types of thin-film resistors respectively.

Lead wires were soldered to the Au layers of the thin-film resistors thus obtained. In this state, the thin-film resistors were held at a temperature of 150° C. for 1000 hours to compare any change in the resistance values with the measured initial values. The rates of change were less than 0.01% respectively.

EXAMPLES 4–17

Thin-film resistance members of various nitrides as shown in the following Table were formed on alumina substrates. Masks were placed on the alumina substrates to expose portions where intermediate layers were to be formed on the thin-film nitride resistance members. Then intermediate layers were formed as shown in the Table. Solderable metal layers as shown in the Table were formed as external connection electrodes for soldering lead wires to the metal layers, thereby forming respective types of thin-film resistors.

TABLE

| Example | Thin-Film Nitride Resistance Member | Intermediate Layer | External Connection Electrode | Rate of Change in Resistance Value |
|---|---|---|---|---|
| 4 | tantalum nitride | cobalt oxide | NiCr—Cu | below 0.01% |
| 5 | tantalum nitride | zinc oxide* | " | " |
| 6 | tantalum nitride | indium oxide | " | " |
| 7 | tantalum nitride | manganese oxide | " | " |
| 8 | tantalum nitride | iron oxide | " | below 0.05% |
| 9 | titanium nitride | manganese oxide | Cr—Cu | below 0.1% |
| 10 | titanium nitride | cobalt oxide | " | below 0.03% |
| 11 | titanium nitride | indium tin oxide | " | " |
| 12 | zirconium nitride | manganese oxide | Ni—Ag | below 0.04% |
| 13 | zirconium nitride | iron oxide | " | " |
| 14 | aluminum nitride | zinc oxide** | NiCr—Cu | below 0.1% |
| 15 | aluminum nitride | tin oxide | " | " |
| 16 | zirconium nitride | manganese oxide<br>iron oxide | Al—Au | below 0.04% |
| 17 | zirconium nitride | nickel oxide<br>iron oxide<br>cobalt oxide | " | below 0.05% |

*Zinc oxide contains 5 percent by mol of lead oxide.
**Zinc oxide contains 1 percent by mol of iron oxide, 1 percent by mol of zirconium oxide and 2 percent by mol of indium oxide.

REFERENCE EXAMPLE 1

A thin-film resistance member of zirconium nitride was formed by the method described above with respect to Example 1.

Then an NiCr layer was formed on the thin-film resistance member of zirconium nitride through a mask by vacuum deposition, and a solderable Cu layer was formed thereon by vacuum deposition, to form an external connection electrode.

A lead wire was soldered to the Cu layer of the thin-film resistor thus obtained, which was then entirely coated with epoxy resin. In which state, the thin-film resistor was held at a temperature of 150° C. for 250 hours, whereby the thin-film resistor of zirconium nitride was changed in color from brown to colorless transparency, while its resistance value was changed over 10% from the measured initial value.

REFERENCE EXAMPLE 2

A thin-film resistance member of tantalum nitride was formed by the method as described above with reference to Example 3.

Then an NiCr layer was formed on the thin-film resistance member of tantalum nitride through a mask by vacuum deposition, and a solderable Au layer was formed thereon by vacuum deposition, to form an external connection electrode.

The thin-film resistor thus obtained was held at a temperature of 150° C. for 1000 hours, whereby the resistance value was changed by 0.5% from the initial value.

Although embodiments of the present invention have been described and illustrated in detail, it is clearly understood that the same is by way of illustration and example only and is not to be taken by way of limitation, the spirit and scope of the present invention being limited only by the terms of the appended claims.

What is claimed is:

1. A thin-film resistor comprising:

a thin-film nitride resistance member;

an external connection electrode for connecting said thin-film nitride resistance member with an external element; and a metal oxide layer interposed between said thin-film nitride resistance member and said external connection electrode, wherein said metal oxide layer comprises at least one metal oxide selected from the group consisting of manganese oxide, iron oxide, cobalt oxide, nickel oxide, zinc oxide, indium oxide, tin oxide and indium tin oxide.

2. A thin-film resistor in accordance with claim 1, wherein said metal oxide comprises a mixture of zinc oxide and about 0.5 to 99.9 percent by mol of at least one metal oxide selected from the group consisting of iron oxide, zirconium oxide, indium oxide, tin oxide and lead oxide.

3. A thin-film resistor in accordance with claim 1, wherein said metal oxide layer comprises a stable metal oxide lower in specific resistance than the thin-film nitride resistance member.

4. A thin-film resistor in accordance with claim 3, wherein said thin-film nitride resistance member comprises at least one nitride of an element selected from the elements in groups III–VI.

5. A thin-film resistor in accordance with claim 3, wherein said thin-film nitride resistance member comprises chromium nitride.

6. A thin-film resistor in accordance with claim 3, wherein said thin-film nitride resistance member comprises at least one nitride of an element selected from the group consisting of tantalum, titanium, zirconium, hafnium, aluminum, niobium, boron, and chromium.

7. A thin-film resistor comprising:

a thin-film nitride resistance member;

an external connection electrode for connecting said thin-film nitride resistance member with an external element; and an intermediate layer interposed between said thin film nitride resistance member and said external connection electrode, said intermediate layer substantially preventing the dissociation of nitrogen from the thin-film nitride resistance member, and the transfer of such nitrogen to the external connection electrode, under high temperature conditions.

8. A thin-film resistor in accordance with claim 7, said intermediate layer further substantially preventing change of the color of the thin-film nitride resistance member under high temperature conditions.

9. A thin-film resistor comprising:

a thin-film nitride resistance member;

an external connection electrode for connecting said thin-film nitride resistance member with an external element; and an intermediate layer interposed between said thin-film nitride resistance member and said external connection electrode, said intermediate layer limiting a change in the resistance value of the thin-film nitride resistance member under high temperature conditions.

10. A thin-film resistor in accordance with claim 9, wherein such change in resistance value is limited to less than about 0.1 percent.

11. A thin-film resistor in accordance with claim 10, wherein such change in resistance value is limited to less than about 0.05 percent.

* * * * *